United States Patent [19]

Gunnewig

[11] Patent Number: 4,755,165

[45] Date of Patent: Jul. 5, 1988

[54] METHOD AND DEVICE FOR SEPARATING TWO LIQUID PHASES BY MEANS OF A CENTRIFUGE

[75] Inventor: Hubert Gunnewig, Oelde, Fed. Rep. of Germany

[73] Assignee: Westfalia Separator AG, Oelde, Fed. Rep. of Germany

[21] Appl. No.: 932,064

[22] Filed: Nov. 18, 1986

[30] Foreign Application Priority Data

Jan. 22, 1986 [DE] Fed. Rep. of Germany ..... 3601814

[51] Int. Cl.[4] ..... B04B 11/02; B04B 1/02

[52] U.S. Cl. ..... 494/37; 494/5; 494/10; 494/22

[58] Field of Search ..... 494/2, 3, 4, 5, 10, 494/22, 23, 27, 30, 35, 37, 56, 57, 58, 59

[56] References Cited

U.S. PATENT DOCUMENTS 3,255,958 6/1966 Simon ..... 494/2
3,445,061 5/1969 Nilson ..... 494/59 X
3,957,197 5/1976 Sartory ..... 494/35 X
4,005,817 2/1977 Charlton ..... 494/22 X
4,305,817 12/1981 Kohlstette ..... 494/3 X

FOREIGN PATENT DOCUMENTS 874427 3/1953 Fed. Rep. of Germany .

*Primary Examiner*—Stuart S. Levy
*Assistant Examiner*—Katherine Matecki
*Attorney, Agent, or Firm*—Sprung Horn Kramer & Woods

[57] ABSTRACT

A method and device for separating two liquid phases by means of a centrifuge. The position of the zone that separates them is varied by supplying additional heavy phase as a function of that position. Once the zone arrives at a certain location, traces of light phase will appear in the heavy-phase outlet. A shutoff is opened and additional heavy phase is supplied for a prescribed length of time through a separate intake, displacing the zone toward another location. The process is repeated, with more heavy phase being diverted through the heavy-phase outlet than is supplied through the product intake.

15 Claims, 2 Drawing Sheets

METHOD AND DEVICE FOR SEPARATING TWO LIQUID PHASES BY MEANS OF A CENTRIFUGE

BACKGROUND OF THE INVENTION

The present invention relates to a method and device for separating two liquid phases that constitute a liquid mixture, which may be contaminated with solids, by means of a centrifuge with a bowl equipped with a stack of disks, with the inside diameter of the stack of disks communicating with an outlet for the light phase and with a diversion channel leading from the periphery of the stack of disks into a central chamber that communicates with an outlet for the heavy phase, whereby the radial position of the zone of separation that evolves between the two liquid phases inside the bowl can be varied by supplying additional heavy phase.

A method and device of this kind are known from German Pat. No. 874 427. The additional supply of heavy phase is controlled as a function of the radial position of the free level of liquid in the central chamber, which communicates with the heavy-phase outlet. This method of control is possible only in relation to product mixtures with phases that differ sufficiently in density and with properties that alter only insignificantly. Otherwise, the zone of separation will migrate impermissibly even though the position of the free level of liquid in the central chamber remains constant, and heavy phase can get into the light-phase outlet or vice versa.

When heavy oils are clarified in a centrifuge for example, the density of the oil and that of the water it contains are so similar that even extremely small variations in the density, temperature, or viscosity of the oil can lead to such impermissible migrations of the zone of separation. The known device is accordingly inappropriate for maintaining the zone of separation in a constant position.

SUMMARY OF THE INVENTION

One object of the present invention is to create a method of controlling the additional supply of heavy phase to the extent that impermissible migrations in the zone of separation can be reliably prevented.

This object is attained in accordance with the invention by an improvement wherein the supply of additional heavy phase is continued for a prescribed length of time as soon as traces of light phase are detected in the heavy-phase outlet.

The same object can be attained in accordance with the invention by an improvement wherein the supply of additional heavy phase is discontinued for a prescribed length of time as soon as traces of heavy phase are detected in the light-phase outlet.

The same object can also be attained in accordance with the invention by an improvement wherein the supply of additional heavy phase is continued as soon as traces of light phase are detected in the heavy-phase outlet and the supply of additional heavy phase is discontinued for a prescribed length of time as soon as traces of heavy phase are detected in the light-phase outlet.

Another object of the invention is to create a device for carrying out the method in accordance with the invention.

This object is attained in accordance with the invention by an improvement wherein the heavy-phase outlet contains a sensor that can detect the presence of traces of light phase in the heavy phase and the intake for the supply of additional heavy phase contains a shutoff that continues the supply of heavy phase when the sensor detects traces of light phase in the heavy-phase outlet and, subject to controls, discontinues the supply of additional heavy phase a prescribed length of time later.

The same object can be attained in accordance with the invention by an improvement wherein the light-phase outlet contains a sensor that can detect the presence of traces of heavy phase in the light phase and the intake for the supply of additional heavy phase contains a shutoff that, subject to controls, discontinues the supply of additional heavy phase as soon as traces of heavy phase are detected in the light phase.

The same object can also be attained in accordance with the invention by an improvement wherein the heavy-phase outlet contains a sensor that can detect the presence of traces of light phase in the heavy phase, the light-phase outlet contains a sensor that can detect the presence of traces of heavy phase in the light phase, and the intake for the supply of additional heavy phase contains a shutoff that, subject to controls, continues the supply of additional heavy phase when traces of light phase are detected in the heavy-phase outlet and discontinues the supply of additional heavy phase when traces of heavy phase are detected in the light-phase outlet.

The intake for the supply of additional heavy phase in one embodiment of the device in accordance with invention communicates with the bowl's product intake.

The intake for the supply of additional heavy phase in another embodiment of the device opens into the central chamber that communicates with the heavy-phase outlet.

The end of the intake for the supply of additional heavy phase that opens into the central chamber in the latter embodiment is preferably a skimmer.

The intake for the supply of additional heavy phase in still another embodiment of the device opens into a chamber that is accommodated in the bowl and communicates through a connecting channel with the diversion channel.

A constriction is interposed in still another embodiment of the device between the diversion channel and the central chamber.

The sensor in still another embodiment of the device is an admittance meter.

Some preferred embodiments of the invention will now be specified with reference to the attached drawings, wherein

DETAILED DESCRIPTION OF THE PREFERRED EMBODIMENTS

Figure 1:
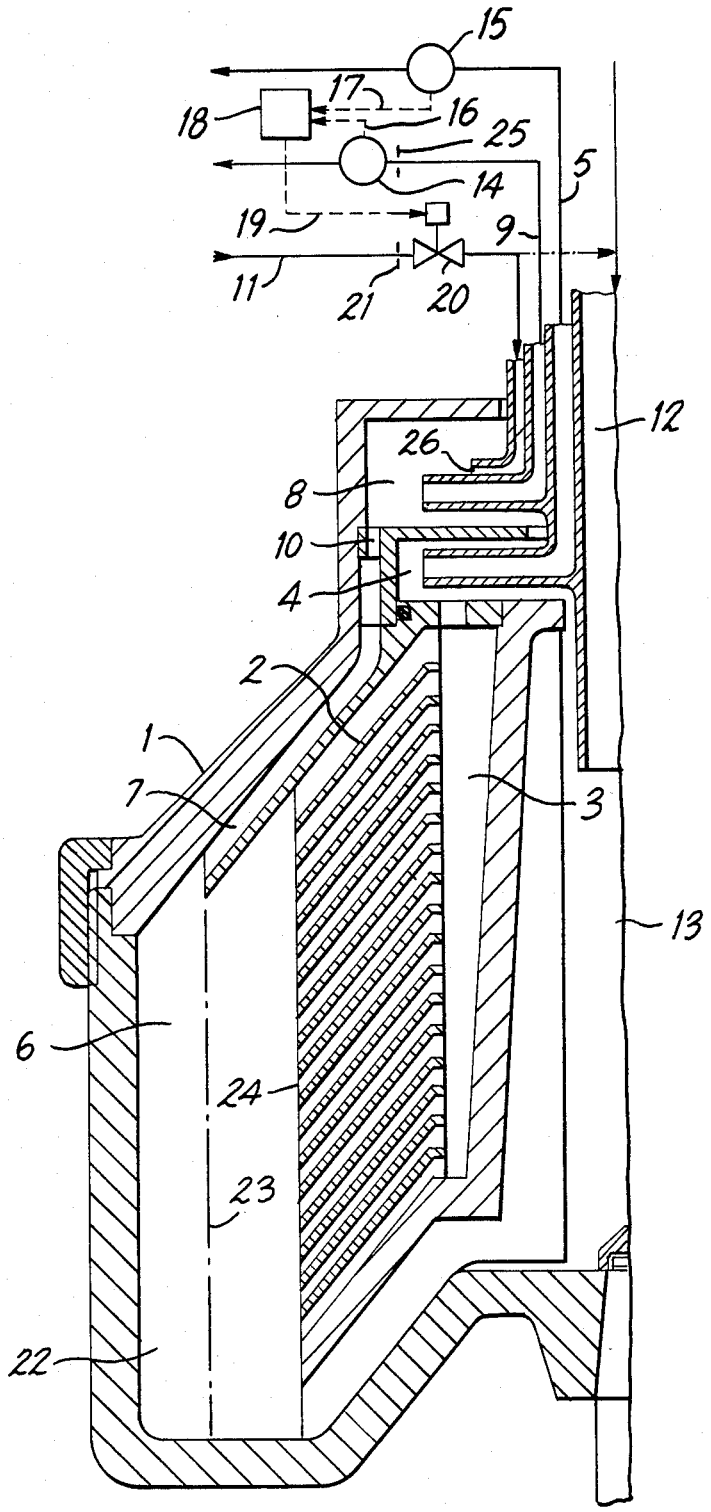
FIG. 1 is a section through a centrifuge bowl, wherein additional heavy phase is supplied to the product intake or to the central chamber

A centrifuge has a bowl 1 equipped with a stack of disks 2. The inside diameter of the stack of disks communicates with an outlet 5 for the light phase through channels 3 and 4. A diversion channel 7 leads from the periphery 6 of the stack of disks into a central chamber 8. The chamber communicates with an outlet 9 for the heavy phase. Between diversion channel 7 and central chamber 8 is a constriction 10. An intake 11 for the supply of additional heavy phase opens either into a product intake 12 or into central chamber 8. Product intake 12 communicates with disk-stack periphery 6 through an inflow space 13. Heavy-phase outlet 9 contains a sensor 14 and light-phase outlet 5 a sensor 15. The sensors communicate with controls 18 through electric lines 16 and 17. An electric line 19 leads from controls 18 to a shutoff 20 in intake 11 for the supply of additional heavy phase. A gate 21 is positioned upstream of shutoff 20.

The mixture to be separated is supplied to bowl 1 through product intake 12, and flows into the periphery 6 of disks 2 through inflow space 13. The solids accumulate in the solids space 22 and the liquid phases separate in periphery 6, with the heavy phase leaving bowl 1 through diversion channel 7, constriction 10, central chamber 8, and heavy-phase outlet 9. The outflow volume must be greater than that of the heavy phase of the liquid constituents in product intake 12.

The light phase leaves bowl 1 through channels 3 and 4 and light-phase outlet 5. The zone that separates the two phases will be located than within the are demarcated by dot-and-dash lines 23 and 24. Since more heavy phase leaves the drum through heavy-phase outlet 9 than is supplied to the drum through product intake 12, the zone of separation will migrate radially outward beyond line 23, and traces of light phase will arrive in heavy-phase outlet 9. Sensor 14 will detect these traces and controls 18 will open shutoff 20 for a prescribed length of time, a length that will prevent the supply of additional heavy phase from displacing the zone of separation inward beyond line 24. Heavy-phase outlet 9 contains a gate 25 that limits the outflow to a level that is lower than that established by the gate 21 in the intake 11 for the supply of additional heavy phase.

The demarcation of the zone of separation can also be varied by initially opening the shutoff 20 in the intake 11 for the supply of additional heavy phase to displace the zone as far as line 24, whereby the sensor 15 in light-phase outlet 5 will detect traces of heavy phase in the light phase, and shutoff 20 will close for a prescribed length of time.

It can also be practical to allow both sensors 14 and 15 to act simultaneously on shutoff 20, exploiting the total permissible area between lines 23 and 24 for the zone of separation, with shutoff 20 not being activated for a prescribed length of time, but being opened by sensor 14 and closed by sensor 15 as each comes into action.

If the additional heavy phase is supplied directly to central chamber 8, the bowl's separation output will not be affected. In this case it is practical for the end of the intake 11 for the supply of additional heavy phase to be a skimmer 26, preventing central chamber 8 from overflowing when the pressure that can be generated by skimmer 26 is higher than the pressure in intake 11.

Figure 2:
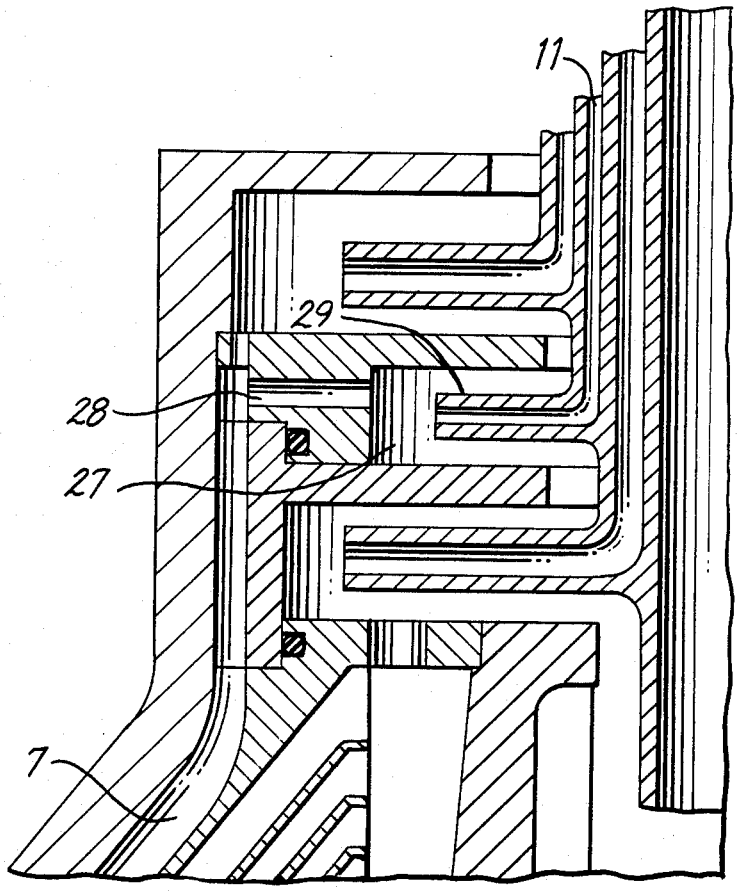
FIG. 2 is a section through a centrifuge bowl, wherein additional heavy phase is supplied to the diversion channel.

With reference now to FIG. 2, it can also be practical to supply the additional heavy phase through a chamber 27 that communicates with diversion channel 7 through a connecting channel 28. It is also practical in this case for the end of the intake 11 for the supply of additional heavy phase to be a skimmer 29.

The solids in solids space 22 can be extracted from the bowl in a known way, either continuously through nozzles or discontinuously through a controlled evacuation system.

It is practical to collet the heavy phase that leaves through outlet 9 in an unillustrated vessel and return some of the liquid to the bowl through the intake 11 for the supply of additional heavy phase.

It will be appreciated that the instant specification and claims are set forth by way of illustration and not limitation, and that various modifications and changes may be made without departing from the spirit and scope of the present invention.

What is claimed is:

1. In a method of separating a light phase and a heavy phase a liquid mixture which may be contaminated with solids, including feeding the mixture into a centrifuge with a bowl having a stack of disks to form a zone of separation therein at a radial position, continuously passing the light phase from a inner diameter of the stack of disks into a light phase outlet and continuously passing the heavy phase from a periphery of the stack of disks into a heavy phase outlet, the improvement comprising: monitoring the heavy-phase outlet for traces of light phase and supplying additional heavy phase to the bowl for a prescribed length of time as soon as traces of light phase are detected in the heavy-phase outlet to vary the radial position of the zone of separation.

2. In a method of separating a light phase and a heavy phase of a liquid mixture which may be contaminated with solids, including feeding the mixture into a centrifuge with a bowl having a stack of disks to form a zone of separation therein at a radial position, continuously passing the light phase from an inner diameter of the stack of disks into a light phase outlet and continuously passing the heavy phase from a periphery of the stack of disks into a heavy phase outlet, the improvement comprising: continuously supplying additional heavy phase to the bowl; monitoring the light phase outlet for traces of heavy phase; and discontinuing the supply of additional heavy phase for a prescribed length of time as soon as traces of heavy phase are detected in the light-phase outlet to vary the radial position of the zone of separation.

3. In a method of separating a light phase and a heavy phase of a liquid mixture which may be contaminated with solids, including feeding the mixture into a centrifuge with a bowl having a stack of disks to form a zone of separation therein at a radial position, continuously passing the light phase from the inner diameter of the stack of disks into a light phase outlet and continuously passing the heavy phase from a periphery of the stack of disks into a heavy phase outlet, the improvement comprising: monitoring the light phase outlet for traces of heavy phase and the heavy phase outlet for traces of light phase; supplying additional heavy phase to the bowl as soon as traces of light phase are detected in the heavy phase outlet and discontinuing the supply of heavy phase when traces of heavy phase are detected in the light phase outlet, whereby the radial position of the zone of separation varies between two extreme positions.

4. In a device for separating a light phase and a heavy phase of a liquid mixture which may be contaminated with solids, comprising a centrifuge with a bowl having a stack of disks receptive of the mixture for forming a zone of separation therein at a radial position, means providing communication between an inner diameter of the stack of disks and a light phase outlet and means providing communication between a periphery of the stack of disks and a heavy phase outlet, the improvement comprising: means for monitoring the heavy phase outlet for traces of light phase and means for supplying additional heavy phase to the bowl for a prescribed length of time as soon as traces of light phase are detected in the heavy-phase outlet to vary the radial position of the zone of separation.

5. The device according to claim 4, wherein the monitoring means comprises a sensor in the heavy phase outlet for detecting the presence of traces of light phase in the heavy phase and the supplying means comprises an intake for the supply of additional heavy phase with a shutoff in the intake and normally blocking flow and controls responsive to the sensor detecting traces of light phase in the heavy-phase outlet for passing a supply of additional heavy phase for said prescribed length of time.

6. In a device for separating a light phase and a heavy phase of a liquid mixture which may be contaminated with solids, comprising a centrifuge with a bowl having a stack of disks receptive of the mixture for forming a zone of separation therein at a radial position, means providing communication between an inner diameter of the stack of disks and a light phase outlet and means providing communication between a periphery of the stack of disks and a heavy phase outlet, the improvement comprising: means for continuously supplying additional heavy phase to the bowl; means for monitoring the light phase outlet for traces of heavy phase; and means for discontinuing the supply of additional heavy phase for a prescribed length of time as soon as traces of heavy phase are detected in the light-phase outlet to vary the radial position of the zone of separation.

7. The device according to claim 6, wherein the monitoring means comprises a sensor in the light phase outlet for detecting the presence of traces of heavy phase in the light phase and the means for discontinuing includes an intake for the supply of additional heavy phase, a shutoff in the intake and normally allowing flow and controls responsive to the detection of traces of heavy phase in the light phase by the sensor for activating the shut-off to block flow for the prescribed length of time.

8. In a device for separating a light phase and a heavy phase of a liquid mixture which may be contaminated with solids, comprising a centrifuge with a bowl having a stack of disks receptive of the mixture for forming a zone of separation therein at a radial position, means providing communication between an inner diameter of the stack of disks and a light phase outlet and means providing communication between a periphery of the stack of disks and a heavy phase outlet, the improvement comprising: means for monitoring the heavy phase outlet for traces of light phase and for monitoring the light phase outlet for traces of heavy phase; means for supplying additional heavy phase to the bowl as soon as traces of light phase are detected in the heavy-phase outlet and means for discontinuing the supply of additional heavy phase as soon as traces of heavy phase are detected in the light-phase outlet, whereby the radial position of the zone of separation varies between two extreme positions.

9. The device according to claim 8, wherein the monitoring means comprises a first sensor in the heavy-phase outlet for detecting the presence of traces of light phase in the heavy phase, and a second sensor in the light-phase outlet for detecting the presence of traces of heavy phase in the light phases, and the means for supplying and discontinuing the supply of additional heavy phase comprises an intake for heavy phase, a shutoff in the intake and controls responsive to the first and second sensors for activating the shut-off to allow flow when light phase is detected by the first sensor and blocking flow when heavy phase is detected by the second sensor.

10. The device as in claim 9, wherein the bowl has a mixture intake and means providing communication between the intake for the supply of additional heavy phase and the bowl's mixture intake.

11. The device as in claim 9, further comprising a central chamber in communication with the heavy phase outlet and wherein the intake for the supply of additional heavy phase opens into the central chamber.

12. The device as in claim 11, wherein the intake for the supply of additional heavy phase opens into the central chamber at an end portion comprising a skimmer.

13. The device as in claim 9, further comprising a central chamber in communication with the heavy phase outlet and a division channel providing communication between the periphery by the stack of disks and the central chamber and wherein the intake for the supply of additional heavy phase opens into a chamber that is accommodated in the bowl and communicates through a connecting channel with the diversion channel.

14. The device as in claim 9, further comprising a central chamber in communication with the heavy phase outlet and a division channel providing communication between the periphery by the stack of disks and the central chamber and wherein the intake for the supply of additional heavy phase opens into a chamber that is accommodated in the bowl and communicates through a connecting channel with the diversion channel.

15. The device as in claim 9, wherein the sensors comprise an admittance meter.

* * * * *

UNITED STATES PATENT AND TRADEMARK OFFICE

CERTIFICATE OF CORRECTION

PATENT NO. : 4,755,165

DATED : July 5, 1988

INVENTOR(S) : Hubert Gunnewig

It is certified that error appears in the above-identified patent and that said Letters Patent is hereby corrected as shown below:

| | |
|---|---|
| Col. 3, line 23 | Delete "than" and substitute --then- |
| Col. 3, line 23 | Delete "are" and substitute --area-- |
| Col. 4, line 1 | Correct --collect-- |
| Col. 4, line 12 | After "phase" insert --of-- |
| Col. 4, line 16 | Before "inner" delete "a" and substitute --an-- |

Signed and Sealed this

Thirty-first Day of January, 1989

*Attest:*

*Attesting Officer*

DONALD J. QUIGG

*Commissioner of Patents and Trademarks*